United States Patent [19]

Leroy et al.

[11] 4,045,215

[45] Aug. 30, 1977

[54] METHOD OF REFINING MATTES CONTAINING NICKEL

[75] Inventors: Pierre Leroy, Saint-Germain-En-Laye; Jean Georges Morlet, Nevers; Jean Saleil, Saint-Etienne, all of France

[73] Assignee: Creusot-Loire, Paris, France

[21] Appl. No.: 682,751

[22] Filed: May 3, 1976

Related U.S. Application Data

[63] Continuation of Ser. No. 487,165, July 10, 1974, abandoned.

[30] Foreign Application Priority Data

July 16, 1973 France ..... 73.25954

[51] Int. Cl.[2] ..... C22B 23/00

[52] U.S. Cl. ..... 75/82

[58] Field of Search ..... 75/82

[56] References Cited

U.S. PATENT DOCUMENTS

| | | | |
|---|---|---|---|
| 1,623,797 | 4/1927 | Lellep | 75/82 |
| 1,680,155 | 8/1928 | Lellep | 75/82 |
| 1,828,752 | 10/1931 | Shoffstall | 75/82 |
| 3,069,254 | 12/1962 | Queneau et al. | 75/82 |
| 3,706,549 | 12/1972 | Knuppel et al. | 75/59 |

*Primary Examiner*—M. J. Andrews

*Attorney, Agent, or Firm*—Cameron, Kerkam, Sutton, Stowell & Stowell

[57] ABSTRACT

Nickel-containing mattes are desulphurized down to low sulphur levels (less than 1%) in a multi-stage process effected in a single converter vessel. In the first stage, an oxidizing gas is blown into the molten matte to reduce the sulphur level to about 4 to 7% and in one or more subsequent stages, oxygen and a diluent are blown into the matte, with a peripheral flow of protective fluid to protect the tuyeres against wear. The diluent, which may be argon or steam for example, dilutes the sulphur dioxide in the matte.

15 Claims, 3 Drawing Figures

METHOD OF REFINING MATTES CONTAINING NICKEL

REFERENCE TO RELATED APPLICATION

Figure 1:
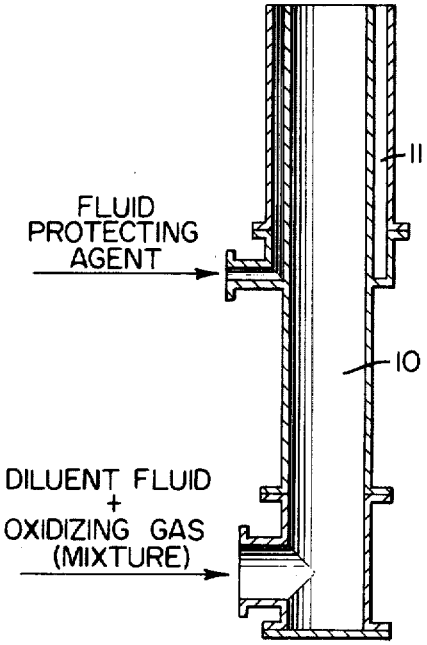

This application is a continuation application of application Ser. No. 487,165 filed July 10, 1974, now abandoned.

The present invention relates to a method of refining mattes containing nickel, down to very low sulphur levels without excessive prohibitive concurrent oxidation of nickel to the oxide.

It is known to refine nickel sulphides in laterally blown converters (called Pierce-Smith converters) by injection of a blast consisting of ordinary air or oxygen-enriched air containing a maximum of 36% oxygen (greater amounts of oxygen cause excessive wear of the tuyeres). The elimination of the sulphur by this method is nevertheless limited by the formation of nickel oxide (NiO), which not only results in an undesirable loss of nickel but also in the formation of a very refractory slag (the fusion point of NiO is in the region of 1950° C). Nickel oxide reacts with sulphur:

$$S + 2\ NiO(S) \rightleftarrows 2\ Ni(1) + SO_2(g)$$

Consideration of the equilibrium constant of this reaction and its dependence upon temperature indicates that the sulphur level obtained by refining can be lowered (without oxidizing nickel too much) either by raising the temperature (when the temperature increases from 1500° to 1600°, the partial pressure of $SO_2$ in equilibrium with a Ni—S—O bath containing 2% of S changes from 0.1 to 0.2 atmospheres), or by lowering the partial pressure of the $SO_2$.

In practice, whereas at the start of refining with about 20% S one can operate at about 1350°, at least 1600° must be reached for 5% or less S. Such temperatures cannot be obtained in Pierce-Smith converters because of the limitation on oxygen content of the blast (insufficient thermal balance) and because their tuyeres are not suited to such temperatures. Consequently, attempts have been made at refining with pure oxygen in a top-blown retort of KALDO type. Such a method enables the content of sulphur to be lowered by oxidation down to about 1%. Very low sulphur contents can only be reached by subsequent treatment under vacuum, the oxidation of the sulphur to $SO_2$ being effected by residual oxygen in the melt (1100 ppm at 1650°).

We have now found that nickel-containing mattes can be refined down to very low sulphur contents, in a single upwards-blown converter without using a vacuum, by effecting the lowering of the partial pressure of $SO_2$ by gaseous dilution. Further, injection of pure oxygen through the bottom of the converter in the initial high-sulphur-content stage can be effected by using our prior proposals for protection of blast-pipes by peripheral injection of a protective agent. Such proposals are described in our United States patent application (as follows) to which reference should be made for further details:

Ser. No. 247,315, filed Apr. 25, 1972 which matured into U.S. Pat. No. 3,844,768 on Oct. 29, 1974.

In the present invention, there is effected in the same converter a first stage of refining at high sulphur contents, with or without dilution gas, with an oxidizing gas which may be pure oxygen (but in that case with a peripheral flow of a protective agent for each tuyere), then one or a number of other successive subsequent stages of refining to lower sulphur contents with a gas diluent for the sulphur dioxide, with or without a peripheral flow of protective agent, and thus to achieve the whole of the desulphurization sought in one and the same converter and without necessarily having recourse to vacuum procedures.

According to the invention, there is provided a method of refining a molten nickel-containing matte to remove sulphur therefrom without excessive oxidation of the nickel which comprises a first oxidative refining stage in which an oxidizing gas is blown from at least one tuyere into the molten matte to lower the sulphur content thereof, and at least one subsequent oxidative refining stage in which oxygen is blown into the matte, below the surface thereof, together with a diluent fluid which dilutes the sulphur dioxide gas formed in the matte during refining, the said oxygen and diluent fluid being blown into the matte as an inner flow from at least one tuyere which is at least double-fed, and wherein a fluid protective agent is also passed into the matte from said tuyere peripherally around the inner oxygen and diluent fluid flow, said protective agent protecting the tuyere against wear.

The method of the invention is carried out in a converter, the oxidizing gas being blown in from the bottom upwards, below the surface of the molten matte.

Figure 2:
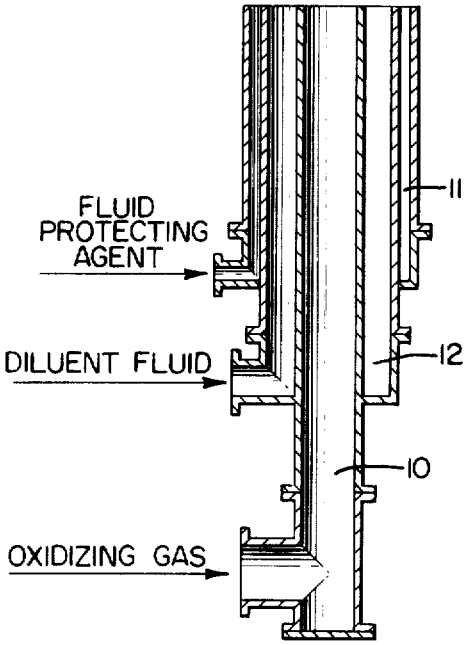
Figure 3:
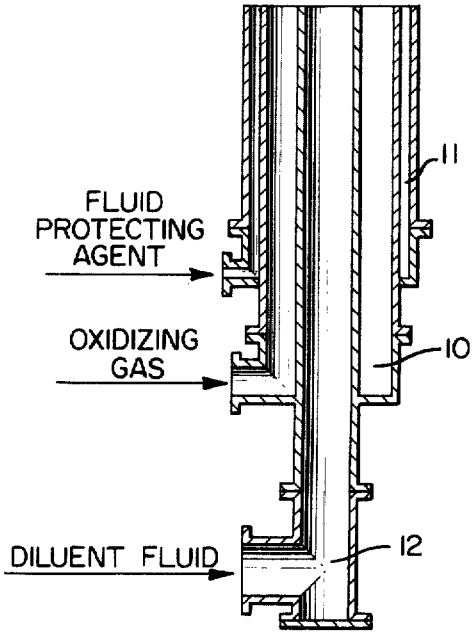

The accompanying drawing shos tuyeres for introducing the gases or fluids into the converter below the surface of the molten matte, FIG. 1 showing a double tuyere and;

FIGS. 2 and 3 showing a triple tuyere.

In one preferred aspect, the first stage is carried out by blowing in pure oxygen until the sulphur content of the matte has been reduced to from 4 to 7%, preferably about 5%, and then the first subsequent stage is commenced using, in addition to oxygen, a diluent for the sulphur dioxide in the matte.

Various features of the subsequent stage)s) are as follows:

a. The inner flow may, for example, consist of ordinary air, or of oxygen-enriched air, or of a mixture of oxygen and an inert gas such as argon, for xample, or of a mixture of oxygen and steam, or of oxygen and atomized water in suspension in the oxygen, or of a mixture of oxygen and carbon dioxide.

b. When a mixture of oxygen and neutral gas is used, the amount of neutral gas can be varied during the refining and is preferably increased until reaching, for example, 70% towards the end of the refining at low sulphur contents.

c. When a non-inert diluent fluid such as steam or carbon dioxide is used, the amount of this diluent fluid in the inner flow can go up to 100% at the end of the refining, since this diluent fluid contributes oxygen which is released for the refining.

d. The peripheral flow of protective agent for each refining jet may consist partially or totally of an inert gas or of steam or of water or of drops of water atomized in a carrier gas or of carbon dioxide or of a gaseous or liquid hydrocarbon such as fuel-oil, for example, or of viscous hydrocarbons or even of an emulsion of one of these constituents in another.

e. If the refining jets have separate double feed, as in FIG. 1 the inner flow 10 of the jets consists of a mixture of oxygen and the diluent for the sulphur dioxide, whilst the peripheral flow 11 consists of the protective agent.

f. If the refining jets have separate triple feed, the central flow and the intermediate flow (together constituting the inner flow) consist either of oxygen or of a diluent fluid or of a mixture of the two, whilst the peripheral flow consists of the protective agent.

Generally, in the first stage, the sulphur content of the matte is reduced from an initial high sulphur content of from 22% to 24%, for example, down to about 4% to 7%. It is possible (although not essential), to blow in pure oxygen in this first stage, with all the advantages of speed and thermal balance which that confers, and to achieve nevertheless only limited wear of the tuyeres and the refractory lining if a peripheral flow of protective agent is also used. Ordinary or oxygen-enriched air, which or without peripheral flow of protective agent, may also be used.

In the first (or only) subsequent stage, it is possible to below in, for example, an equal amount of oxygen and of diluent fluid, either in a mixture in the central portion of a double-separate-feed jet (FIGS. 2 and 3) or in mixtures or separately in the central and intermediate portions 12 of a triple-separate-feed jet (FIGS. 2 and 3), whilst protecting the tuyeres and the lining by a peripheral flow of protective agent.

If desired, further subsequent stages may be used at very low sulphur contents, when it is possible to blow in a proportion of oxygen much lower than 50% (and even none at all), and a proportion of diluent fluid much greater than 50% (even up to 100%).

Any number of subsequent stages may be used, e.g. 2, 3 or 4, with increasing proportions of fluid diluent in the gas flow.

Towards the end of the refining, it may be desirable to replace a protective agent which is highly effective against wear and which contributes hydrogen, much as fuel-oil, for example, by another protective agent which is less effective against wear (but sufficient when the central jet has become not very strongly, or even not at all, oxidizing), this new agent not contributing hydrogen and ensuring a final stirring of the matte. Examples are ordinary air or nitrogen or argon.

Although it is not essential, the matte may be put under vacuum during the final stages of the method of the invention if very low sulphur contents are required.

At each subsequent stage of the refining, the proportion of diluent fluid is suited to the range of sulphur content in the matte solely as a function of considerations of physico-chemical order and without worrying about the protection of the tuyeres against wear, which protection is ensured by the protective agent.

In order that the invention may be more fully understood, the following Example is given by way of illustration only.

EXAMPLE

A nickel matte obtained by the method of separation of mattes by controlled solidification, contained 73% nickel and 22% sulphur. It was refined by the method of the invention as follows.

The refining was carried out in an 18-ton converter furnished with 6 tuyeres each having three concentric tubes enabling a total 120 $Nm^3$/min of pure oxygen to be blown in at the centers and in the intermediate passages, (i.e. 20 $Nm^3$/min per tuyere), and protected by a peripheral feed of fuel-oil at the rate of 0.9 liters/min/-blast-pipe (or 5.4 liters/minute in total for the 6 blast-pipes). At the start of blasting, the matte was at 1380° C.

The first stage lasted 22 minutes with the above flow rates. At the end of this stage, the matte contained 5.1% sulphur. The temperature has been deliberately kept down to 1620° C by the addition of solid matte, nickel scrap, etc. for cooling. The consumption of fuel-oil during this first stage was 120 liters.

For the first subsequent refining stage, steam was introduced at the centers of the tuyeres and pure oxygen in the intermediate passages. The cross-sectional areas of the passages were calculated so that the two normal volumetric flows of stream and oxygen were equal, taking into account the blast pressures available. The oxygen was blown in at 30 $Nm^3$/min, the stream at 30 $Nm^3$/min, or 24 Kg/min, for 11 minutes. In the peripheral passages of the tuyeres, the same flow of fuel-oil was maintained as previously (or 0.9 1/min/blast-pipe).

At the end of the first subsequent stage, the matte contained 0.8% sulphur and was at 1660° C. The consumption of fuel-oil in this stage was 60 liters.

A second subsequent stage was then carried out by blowing in steam both in the central passages and in the intermediate passages in the tuyeres, the fuel-oil being replaced by air (for stirring) in the peripheral circuits of the tuyeres. The stream was introduced at a total flow of 60 Kg/min. for 3 minutes. The sulphur content in the matte fell to 0.025% and the temperature to 1630° C.

The metallurgical operation was concluded by introduction of nitrogen into the three tuyere circuits in order to cause stirring of the matte for about 6 minutes so as to eliminate the hydrogen coming from the fuel-oil on the one hand and the steam on the other. Further, by addition of coke to the slag, there was obtained reduction of the nickel oxide in the slag. If it is preferred to avoid any introduction of nitrogen into the matte, the nitrogen can be replaced at least during the last period of stirring by argon, for example.

The above Example refers to a nickel matte which has already undergone removal of iron in a Pierce-Smith converter and separation of copper by controlled solidification. It is obvious that the removal of iron prior to desulphurization may be effected in the same converter which is used subsequently for the method of desulphurization in accordance with the invention. The first phase of blowing in, becoming significantly longer, has then as its first object the removal of iron and as its second object partial desulphurization as described above.

On the other hand, the method in accordance with the invention is suitable for desulphurizing mattes containing both nickel and copper. In this case, the separation of the nickel and the copper is effected by carbonylation of the product proceeding from the converter which has ensured desulphurization in accordance with the invention. This separation is therefore subsequent to the desulphurization.

We claim:

1. A method of refining a molten nickel-containing matte containing in excess of 7% sulphur to remove sulphur therefrom without excessive oxidation of the nickel, comprising in a first oxidative refining stage the step of blowing an oxidizing gas from at least one tuyere into the molten matte below the surface thereof to lower the sulphur content thereof, and when the sulphur content of the matte is from 4 to 7% in at least one subsequent oxidative refining stage producing nickel with a low sulphur content including continuing the blowing of said oxidizing gas into the matte, below the surface thereof, together with an added diluent fluid for sulphur dioxide which dilutes the sulphur dioxide gas formed in the matte during refining, said oxygen and diluent fluid being blown into the matte as an inner flow from at least one tuyere, and passing a fluid tuyere protective agent separate from said diluent fluid into the matte from said tuyere peripherally around the inner oxidizing gas and diluent fluid flow, said protective agent protecting the tuyere against wear.

2. A method according to claim 1 wherein, in said first stage, the oxidizing gas is selected from the group consisting of air, oxygen-enriched air and pure oxygen.

3. A method according to claim 1 wherein, in said first stage, the additional step of passing a fluid protective agent through the tuyere into the matte peripherally of the oxidizing gas to protect the tuyere against wear.

4. A method according to claim 1, wherein said first stage, the oxidizing gas is pure oxygen.

5. A method according to claim 4, wherein said subsequent stage is begun when the sulphur content of the matte is approximately 5%.

6. A method according to claim 1 wherein said diluent fluid is selected from the group consisting of argon and nitrogen, and including the step of first using nitrogen and subsequently using argon.

7. A method according to claim 1, including the step of subjecting the matte to a reduced pressure when the sulphur content is low.

8. A method according to claim 1, wherein the diluent fluid is steam.

9. A method according to claim 1, wherein the diluent comprises water droplets suspended in oxidizing gas, which droplets vapourise on contact with the matte.

10. A method according to claim 1, wherein the proportion of fluid diluent in the said central flow is increased as the sulphur content of the matte decreases.

11. A method according to claim 1, wherein the protective agent is selected from the group consisting of fuel-oil, and emulsions of argon in fuel-oil.

12. A method according to claim 1, including in said subsequent oxidative refining stage, the steps of using multiple-feed gas jets, feeding said jets by blast-pipes and separating said oxidizing gas, said diluent fluid and said protective agent along the whole length of said pipes.

13. A method of refining a molten nickel-containing matte to remove sulphur therefrom comprising the steps of subjecting the molten matte to a first oxidative refining stage and then to at least two further oxidative refining stages, said first stage, including the steps of blowing an oxidizing gas selected from the group consisting of pure oxygen, oxygen-enriched air and air through tuyeres into said matte, reducing the sulphur content of the matte to a level of from about 7% to 4%, and said at least two further stages including the steps of blowing oxygen into the matte below the surface thereof together with a diluent fluid which dilutes the sulphur dioxide in the matte, with a decreasing proportion of oxygen and an increasing proportion of diluent fluid from one of said further stages to the next of said further stages, blowing said oxygen and diluent fluid into the matte as an inner flow through at least one tuyere of a double-feed or triple-feed, and feeding a separate fluid protective agent into the matte through said at least one tuyere peripherally around said inner flow, said agent protecting said tuyere against water.

14. A method according to claim 13, said first stage including the steps of introducing the oxidizing gas into the molten matte through at least one tuyere and simultaneously introducing a separate peripheral flow through said tuyere of a fluid protective agent, said agent protecting the tuyere against wear.

15. A method according to claim 13, wherein the diluent fluid is selected from the group consisting of argon, steam and water droplets.

* * * * *